US006221317B1

(12) United States Patent
Carl

(10) Patent No.: US 6,221,317 B1
(45) Date of Patent: Apr. 24, 2001

(54) UNIVERSAL PIPETTE TIP BOX

(75) Inventor: Richard A. Carl, Rancho Palos Verdes, CA (US)

(73) Assignee: CCS Packard, Inc., Torrance, CA (US)

( * ) Notice: Subject to any disclaimer, the term of this patent is extended or adjusted under 35 U.S.C. 154(b) by 0 days.

(21) Appl. No.: 09/302,525

(22) Filed: Apr. 30, 1999

(51) Int. Cl.[7] ..... B01L 3/02; B01L 9/00

(52) U.S. Cl. ..... 422/104; 422/100; 422/102; 206/562; 211/60.1

(58) Field of Search ..... 422/100, 102, 422/109; 220/507, 527; 206/372, 382, 383, 443, 562, 563, 564, 486; 211/70.6, 60.1, 71

(56) References Cited

U.S. PATENT DOCUMENTS 4,577,760 * 3/1986 Rainin et al. .
5,324,482 * 6/1994 Scaramella et al. .
5,622,676 * 4/1997 Lind .
5,630,988 * 5/1997 Stolp .
5,642,816 * 7/1997 Kelly et al. .
5,827,745 * 10/1998 Astle .
5,882,603 * 3/1999 Taggart .
6,098,802 * 8/2000 Asa et al. .

FOREIGN PATENT DOCUMENTS 296 07 444 * 8/1997 (DE) .

* cited by examiner

*Primary Examiner*—Jan Ludlow
(74) *Attorney, Agent, or Firm*—Irving Keschner

(57) ABSTRACT

A pipette tip box assembly having a universal format capable of accommodating a wide variety of different pipette tip arrays. The footprint of the pipette tip box portion of the assembly is fixed to a standard (SBS) specification for microplates making the tip box compatible with the wide variety of hardware that is currently being used in automated microplate processes. The tip box portion of the pipette tip box incorporates an asymmetrical distribution of deck plate locking pins on the upper surface to retain pipette receiving deck plates having various arrays of openings thereon. The pipette tip box cover of the assembly utilizes an interlocking feature for mating pipette tip boxes within a stack of such boxes. This feature provides enhanced stability of large stacks of pipette tip boxes that are frequently required for automated processes.

9 Claims, 3 Drawing Sheets

UNIVERSAL PIPETTE TIP BOX

BACKGROUND OF INVENTION

1. Field of Invention

The present invention provides a pipette tip box capable of accommodating a variety of different pipette tip configurations.

2. Description of the Prior Art

Pipette tips are typically small, plastic, cylindrical devices that are utilized for aspirating and dispensing variable liquid volumes. The length, diameter and shape of the tips vary in accordance with an individual manufacturer's specifications. Due to variations in pipette tip size, the boxes in which the pipettes are packaged and stored also varies.

The pipette tip industry has not, at this time, adopted standards with respect to the dimensions of pipette tip boxes or the bases of these boxes (footprints). Because of these variations, pipette tip box manufacturers are required to fabricate new molds in which to cast boxes that will accommodate the various pipette tip configurations. This would require each manufacturer to assume the cost involved with building molds capable of casting newly designed pipette tip boxes.

What is thus desired is to provide a universal pipette tip box design that provides a format capable of accommodating a wide variety of different pipette tip configurations.

SUMMARY OF THE PRESENT INVENTION

The present invention provides a universal pipette tip box having a format capable of accommodating a wide variety of different pipette tip arrays.

The interior portion of the box base possesses an open architecture that allows pipette tip manufacturers to package 24, 96, 384 or 1536 tips in a variety of physical arrangements within the box. This provides pipette tip manufacturers with flexibility in packing tips, and also decreases production expenses.

The interior of the box base is molded into a grid-like pattern, thus enabling the box to have vastly enhanced physical rigidity over conventional box designs.

The footprint of the box is fixed to a standard specification set for microplates (SBS standard). Because of compliance with standards, boxes of the present invention are compatible with the wide variety of hardware that is currently being used in automated microplate processes. This allows pipette tip end-users to incorporate the new tip box into their current procedures without purchasing additional processing equipment.

The box bases possess an asymmetrical distribution of deck plate locking pins providing the end-users of the pipettes with a visual means of loading pipette tip boxes into automated devices in an appropriate orientation and eliminates any molding variations that might occur in the box base and deck plate. By always forcing the orientation of the deck plate and box base, manufacturing errors are minimized.

The box utilizes an interlocking feature for mating pipette tip boxes within a stack of boxes. This feature provides enhanced stability of large stacks of pipette tip boxes that are frequently required for automated processes.

The present invention provides a universal pipette tip box capable of accommodating a wide variety of different pipette tip configurations, or arrays, thus reducing manufacturing costs, the box also having increased physical rigidity.

DESCRIPTION OF THE DRAWING

For a better understanding of the invention as well as other objects and further features thereof, reference is made to the following description which is to be read in conjunction with the drawing wherein.

DESCRIPTION OF THE INVENTION

Figure 1:
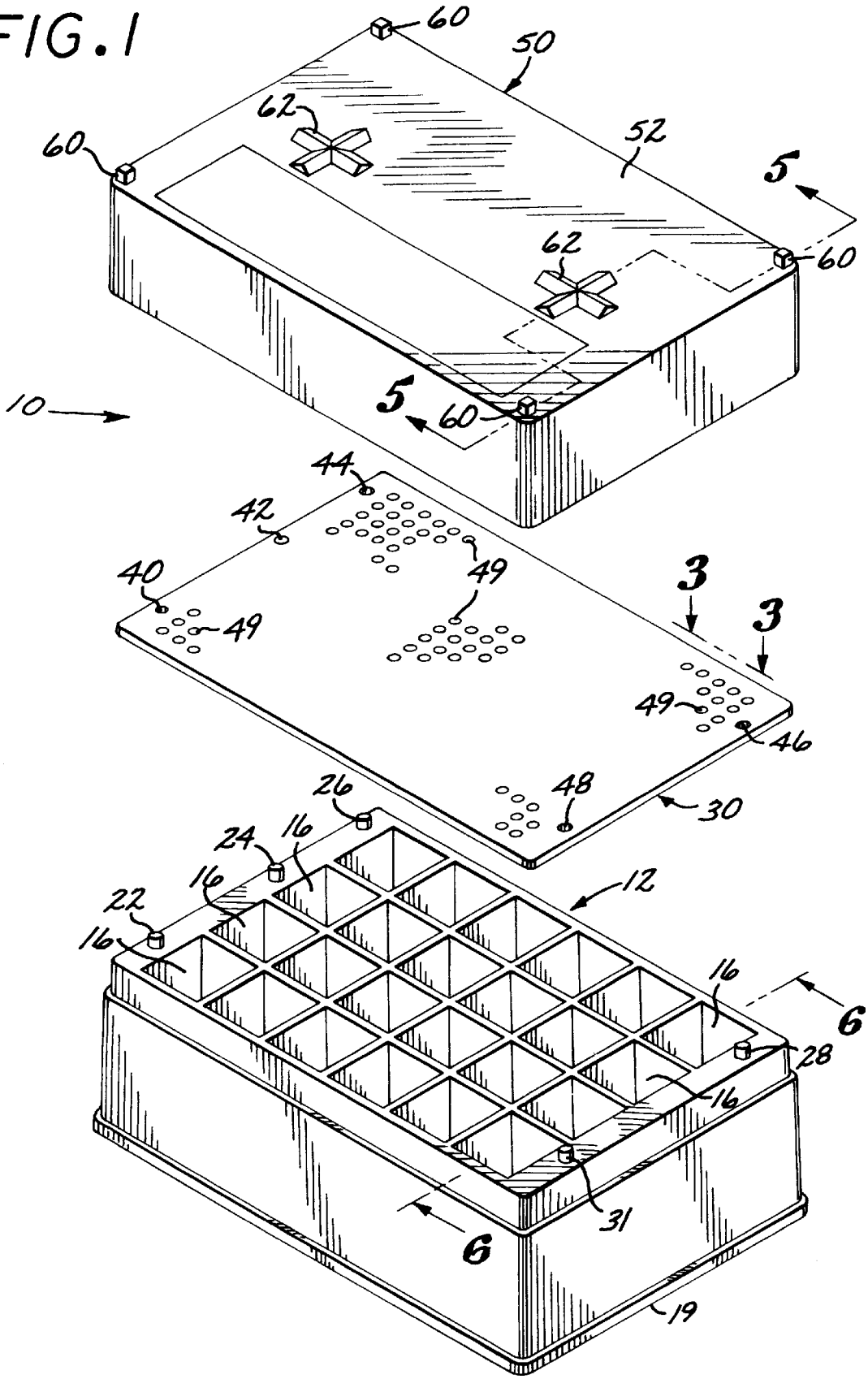
FIG. 1 is an exploded assembly view showing the components of the novel pipette tip box assembly of the present invention.

Referring now to FIG. 1, an exploded assembly view of the novel pipette tip box assembly 10 of the present invention is illustrated.

Pipette tip box 10 assembly comprises pipette tip box 12, deck plate 30 and cover 50. Pipette tip box 12 of assembly 10 comprises a housing 14, preferably molded from plastic, having a plurality of hollow, square shaped elongated recesses 16 extending to the bottom lip 19 of tip box 12. This grid-like design provides the tip box 12 with enhanced physical rigidity over prior art tip box designs and functions to recieve the bottom portion of pipettes inserted into deck plate 30. Tip box 12 is designed so that a number of pipette tips extending through the bottom surface of deck plate 30 are received in coaligned recesses in tip box 12. This increased rigidity is significant since it allows tip box 12 to withstand the high pressures that pipette tip boxes are subject to during various automated processes. It should be noted that although twenty four recesses 16 are shown, either fewer or greater number of recesses can be provided depending upon system requirements. In addition, the recesses can have different shapes, such as rectangular, circular, etc.

The upper surface 20 of tip box 12 has a plurality of deck plate locking pins 22, 24, 26, 28 and 31, asymmetrically positioned therearound as illustrated. This feature provides the end-users of the pipettes with a visual means of loading pipette tip boxes into automated devices in a proper orientation and minimizes any molding variations that might otherwise occur in the tip box 12 and deck plate 30. By forcing the deck plate 30 and tip box 12 to be orientated in a particular direction, manufacturing errors are minimized. This enables high throughput processing since pipette tip box mishandling will be minimized.

Pipette deck plate 30 comprises a thin, rectangular shaped plastic lid member having holes 40, 42, 44, 46 and 48. When assembled, pin 22 of tip box 12 extends into hole 40 of deck plate 30, pin 24 extends into hole 42, pin 26 extends into hole 44, pin 28 extends into hole 46 and pin 31 extends into hole 48. The deck plate 30 is thus friction engaged to pipette tip box 12 releasably securing the two members together. It should be noted that deck plate 30 of the same predetermined shape and dimensions can be designed with 96, 384 or 1536 pipette supporting holes 49, depending upon user requirements thus effectively making the pipette tip box universal in function and use. The top surface 52 of pipette tip cover 50 has interlocking members formed thereon to allow for mating a pipette tip box with a stack of similar boxes. This feature provides enhanced stability of large stacks of pipette tip boxes that are frequently required for automated purposes.

The interlocking mechanism comprises four upwardly extending posts 60, preferably located at the corners of top surface 52, and a pair of cross-shaped protrusions 62.

Figure 2:
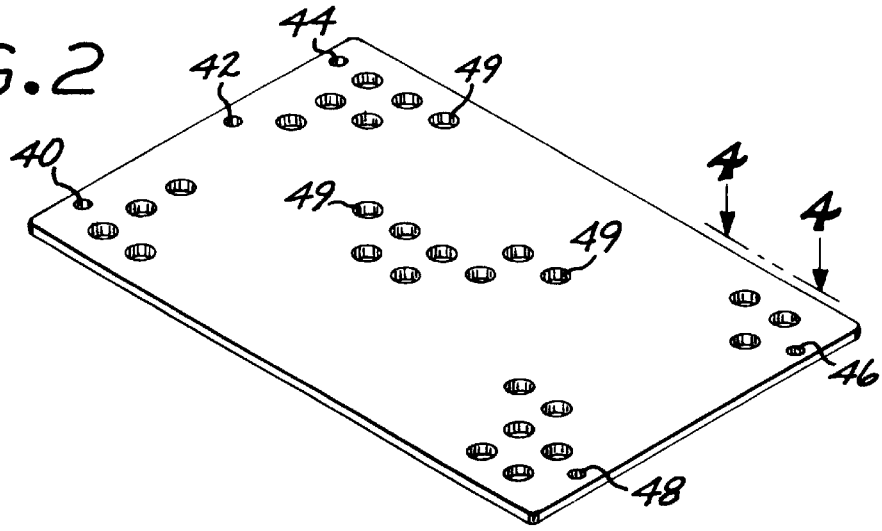
FIG. 2 is a perspective view of a pipette deck plate which can be used with the pipette tip box of the present invention.
Figure 3:
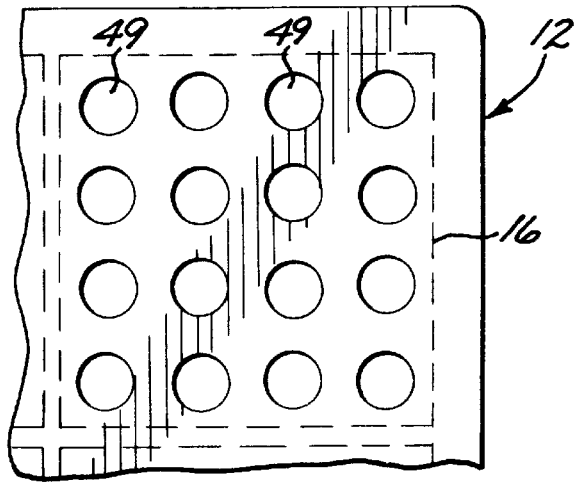
FIG. 3 is a view along line 3—3 of FIG. 1.
Figure 4:
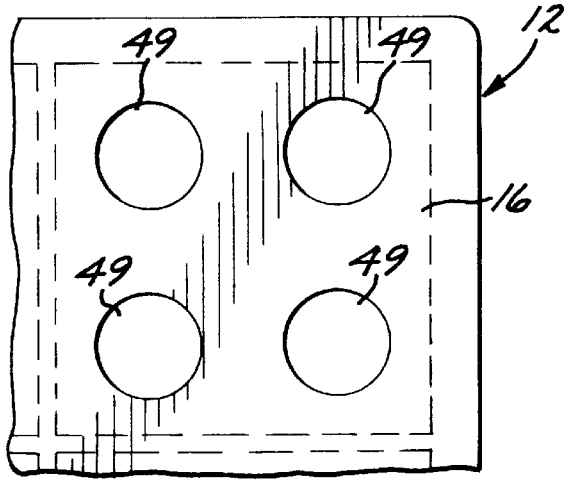
FIG. 4 is a view along line 4—4 of FIG. 2.

FIG. 2 is a more detailed view of deck plate 30. It should be noted that the drawing illustrates the hole layout in a simplified format—as shown more clearly in FIG. 3, the hole arrangement is a series of repeating equal spaced holes formed in rows and columns and positioned over a recess 16 in tip box 12. FIG. 4 is similar to FIG. 3 but shows a different pattern of holes 49 overlying recess 16.

Figure 5:
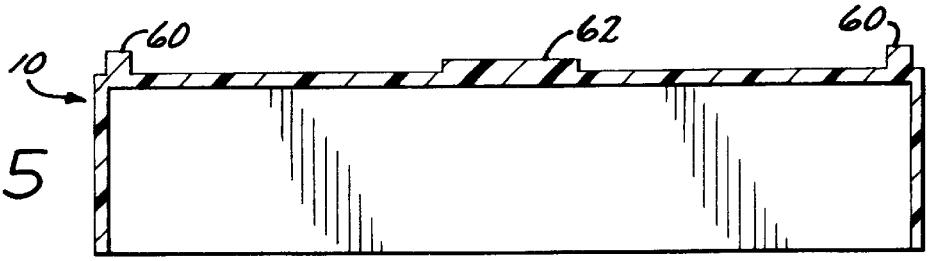
FIG. 5 is a sectional view along line 5—5 of FIG. 1.

FIG. 5 is a cross-sectional view showing the interlocking mechanisms 60 and 62.

Figure 6:
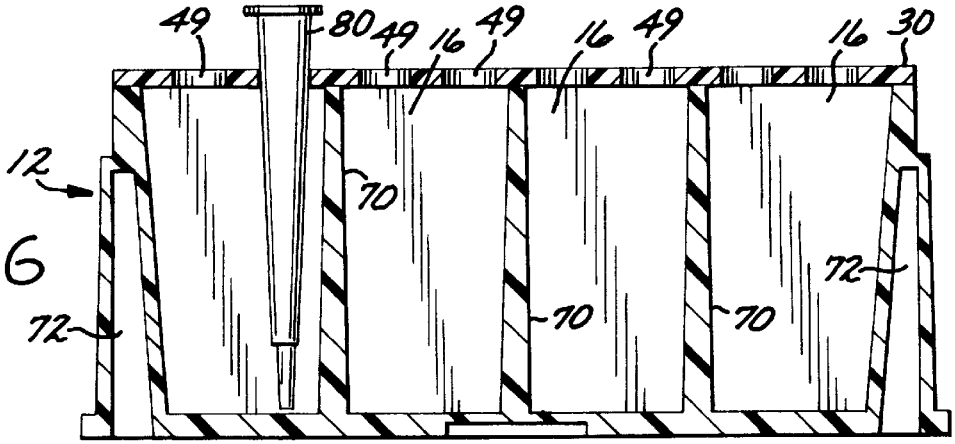
FIG. 6 is a sectional view along line 6—6 of FIG. 1.

FIG. 6 is a sectional view of the base of pipette tip box 12, and illustrates vertical extending walls 70 separating recesses 16 and vertically extending receiving chambers 72.

Figure 7:
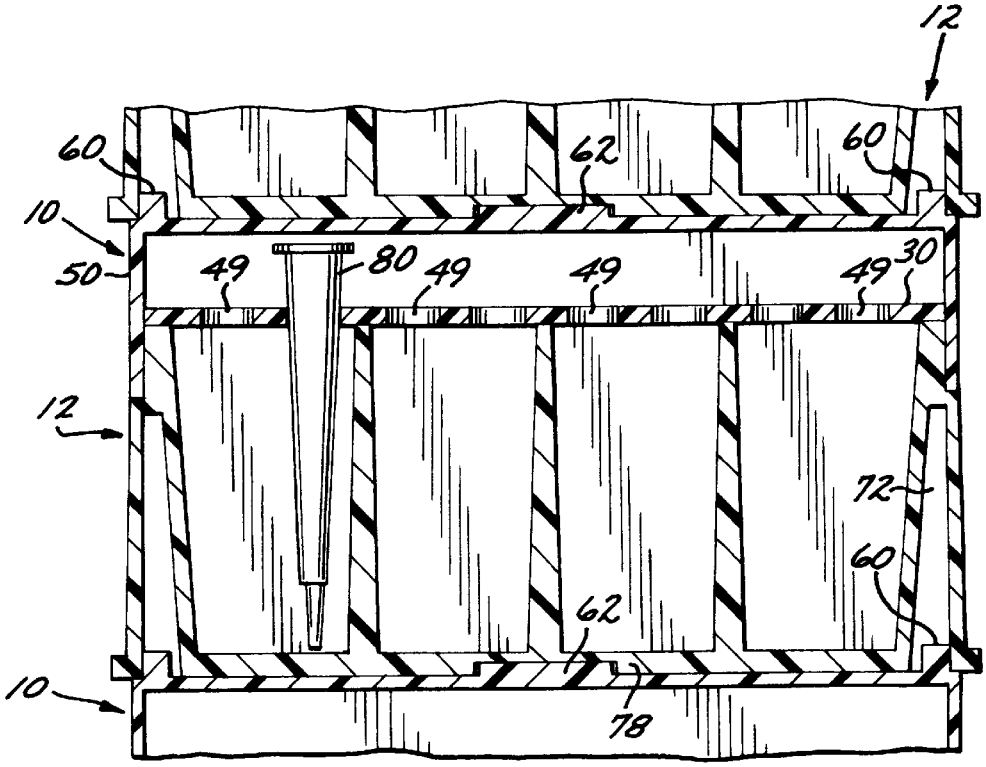
FIG. 7 illustrates the assembled components of FIG. 1.

FIG. 7 illustrates assembled pipette tip boxes 10 in a stacked array. Correct and stable stacking is accomplished by having the interlocking mechanisms of one array interact with the box placed on top of cover 50.

In particular, posts 60 (FIG. 7) extend into corresponding chambers 72 and cross-shaped members 62 fit into the adjacent portion of the grid pattern formed on the bottom surface 78 of tip box 12.

In operation, the user first selects a deck plate 30 having the number of holes corresponding to the desired number of pipettes. The selected deck plate 30 is then secured to the pipette box 12 via locking pins 22, 24, 26, 28 and 31, the pipette tips then loaded into holes 49 therein and the cover 50 then placed over the deck plate 30. A pipette tip 80 is shown positioned in the deck plate 30 for illustrative purposes.

While the invention has been described with reference to its preferred embodiment, it will be understood by those skilled in the art that various changes may be made and equivalents may be substituted for elements thereof without departing from the true spirit and scope of the invention. In addition, many modifications may be made to adapt a particular situation or material to the teaching of the invention without departing from its essential teachings.

What is claimed is:

1. A pipette tip box assembly comprising:

a tip box comprising a bottom member having first and second surfaces and a plurality of outside walls extending upwardly from said bottom member and terminating in edges having support surfaces thereon, a plurality of locking members being formed on selected ones of said support surfaces, and a plurality of internal walls extending upwardly from said bottom member forming a plurality of internal recesses; and a plate member of a predetermined shape and having first and second surfaces, a first set of holes extending through said plate member and positioned towards the outer perimeter of said plate member first and second surfaces, said locking members extending into coaligned holes in said first set of holes, a second set of holes for supporting pipette tips extending through said plate member first and second surfaces being formed in the remaining surface area thereof.

2. The pipette tip box assembly of claim 1 wherein said locking members releasably secure said tip box and said plate member together.

3. The pipette tip box assembly of claim 1 wherein said plate member has N holes, with N being greater than 1.

4. The pipette tip box assembly of claim 3 wherein said plate member has M holes, M being greater than N.

5. The pipette tip box assembly of claim 1 further including a cover member having a first surface and a plurality of sidewalls extending therefrom, a plurality of post members extending upwardly from the first surface of said cover member.

6. The pipette tip box assembly of claim 5 wherein said post members are positioned adjacent each corner of said cover member.

7. The pipette tip box assembly of claim 6 wherein said first surface of said cover member has a plurality of shaped protrusions formed thereon.

8. The pipette tip box assembly of claim 7 wherein said post members extend into receiving chambers formed in the bottom of another pipette tip box assembly stacked thereon.

9. The pipette tip box assembly of claim 8 wherein said shaped protrusions fit into corresponding shaped recesses formed in the bottom surface of said another pipette tip box.

* * * * *